United States Patent [19]

Kersey

[11] 4,449,686

[45] May 22, 1984

[54] DISPLAY FIXTURE MOUNTING BRACKET

[75] Inventor: Melvin L. Kersey, Paragould, Ark.

[73] Assignee: Darling Store Fixtures, Paragould, Ark.

[21] Appl. No.: 378,918

[22] Filed: May 17, 1982

[51] Int. Cl.[3] ..... A47B 96/06; A47G 55/00

[52] U.S. Cl. ..... 248/215

[58] Field of Search ..... 248/215, 227, 301, 304, 248/309 A, 214, 226.1

[56] References Cited

U.S. PATENT DOCUMENTS

| | | | |
|---|---|---|---|
| 336,671 | 2/1886 | Stevens . | |
| 884,361 | 4/1908 | Broga . | |
| 2,206,775 | 7/1940 | Hoofer | 248/214 |
| 2,665,869 | 1/1954 | Samuels . | |
| 3,056,570 | 10/1962 | Slavin | 248/231.4 |
| 3,189,308 | 6/1965 | Schaefer . | |
| 3,536,287 | 10/1979 | Kramer | 248/301 |
| 3,717,258 | 2/1973 | McKinnon . | |
| 4,059,248 | 11/1977 | Kuntz | 248/214 |

FOREIGN PATENT DOCUMENTS

| | | |
|---|---|---|
| 680327 | 10/1952 | United Kingdom . |
| 743311 | 1/1956 | United Kingdom . |
| 991208 | 5/1965 | United Kingdom . |
| 1152469 | 5/1969 | United Kingdom . |
| 1233370 | 5/1971 | United Kingdom . |
| 1328849 | 9/1973 | United Kingdom . |
| 1426282 | 2/1976 | United Kingdom . |
| 1498626 | 1/1978 | United Kingdom . |
| 1535539 | 12/1978 | United Kingdom . |
| 1543674 | 4/1979 | United Kingdom . |
| 2070915 | 2/1981 | United Kingdom . |

*Primary Examiner*—William H. Schultz
*Assistant Examiner*—Ramon O. Ramirez
*Attorney, Agent, or Firm*—Emch, Schaffer & Schaub

[57] ABSTRACT

A mounting bracket for a hanger arm that is supporting on a hangrod is disclosed. The mounting bracket is positioned on one end of the hanger arm and the bracket is disposed for engaging the hangrod to mount the hanger arm on the hangrod. A pin is moveably positioned in the bracket with one end of the pin extending from the bracket towards the hangrod. Means is provided for biasing the moveable pin towards the hangrod whereby the pin releasably engages the hangrod to maintain the bracket and hanger arm in position on the hangrod.

19 Claims, 3 Drawing Figures

DISPLAY FIXTURE MOUNTING BRACKET

BACKGROUND OF THE INVENTION

The invention relates to a mounting bracket for a hanger arm used on a display fixture. The mounting bracket is designed to allow the hanger arm to be removably positioned on a hangrod that is secured to the display fixture. The mounting bracket includes a movable pin that is utilized to secure the mounting bracket and hanger arm to the hangrod. To remove the hanger arm the pin must be displaced in a manner that allows disengagement of the mounting bracket. However, when the pin is in position the pin acts to secure the hanger arm on the hangrod and prevents accidental disengagement of the hanger arm. The configuration of the mounting bracket also allows the hanger arm to be moved in an axial direction along the hangrod while the mounting bracket and hanger arm remain secured to the hangrod.

Hanger arms for display fixtures have been utilized for a number of years. Since the arrangement of the display fixture and the goods displayed thereon are constantly changing it is essential to have a hanger arm that can be easily positioned on a hangrod connected to the display fixture. It is also essential that the hanger arm can be easily removed or repositioned with respect to the display fixture either for the purpose of re-arranging the display fixture or for moving the display fixture. One example of a prior art mounting bracket used with a hanger arm on a display fixture utilizes a substantially inverted J-shaped bracket that is connected to one end of a hanger arm. The inverted J-shaped bracket is positioned over a substantially square hangrod to secure the hanger arm to the display fixture. Although this mounting bracket is satisfactory for most applications the bracket has the disadvantage that it is held in place only by the force of gravity. Accordingly, it is possible to accidentally or unintentially dislodge the mounting bracket and hanger arm from the hangrod. The significants of this disadvantage can be more fully appreciated when it is realized that such display fixtures are normally used in stores where crowds and children can subject the display fixture to a great deal of wear and tear. To avoid liability problems for accidents and to ensure that goods are properly displayed for sale it is important to have a hanger arm for a display fixture that is not subject to being accidentally removed.

Accordingly, there is a need for a hanger arm that can be securely positioned on a display fixture. The hanger arm should be capable of being easily positioned on and removed from the display fixture. In addition, the hanger arm should be capable of being moved axially along the hangrod of the display fixture without removing the hanger arm from the display fixture. However, such a hanger arm should be secured to the display fixture to prevent accidental disengagement of the hanger arm.

SUMMARY OF THE INVENTION

The invention is directed to a mounting bracket for a display fixture. A hanger arm is provided upon which items to be displayed can be positioned. A hangrod is positioned for supporting the hanger arm. A mounting bracket is positioned on one end of the hanger arm and the bracket is disposed for engaging the hangrod to mount the hanger arm on the hangrod. A pin is movably positioned in the bracket with the first end of the pin extending from the bracket towards the hangrod. Means is provided for biasing the movable pin towards the hangrod whereby the pin releasably engages the hangrod to maintain the bracket and hanger arm in position on the hangrod.

It is an object of the invention to provide an improved mounting bracket for a hanger arm.

It is also an object of the invention to provide a mounting bracket for a hanger arm that effectively prevents accidental disengagement of the hanger arm.

Other objects and advantages of the invention will become apparent as the invention is described hereinafter in detail and with reference to the accompanying drawings.

DESCRIPTION OF THE PREFERRED EMBODIMENTS

Figure 1:
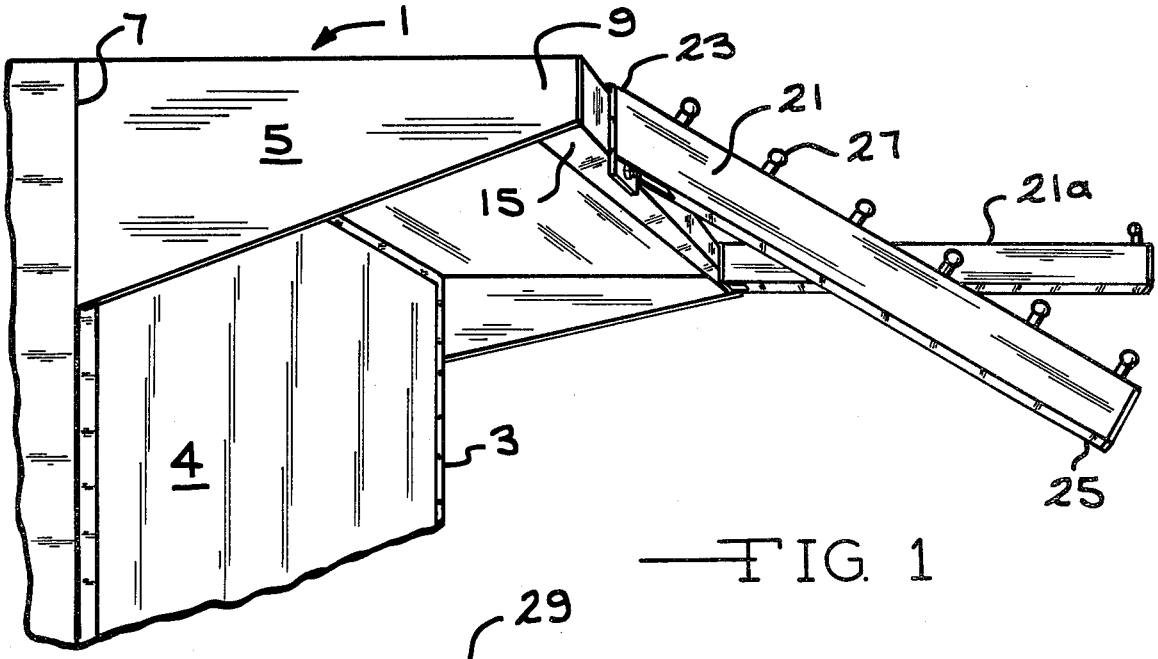
FIG. 1 is a side perspective view of a display fixture utilizing the hanger arm mounting bracket of the present invention.
Figure 2:
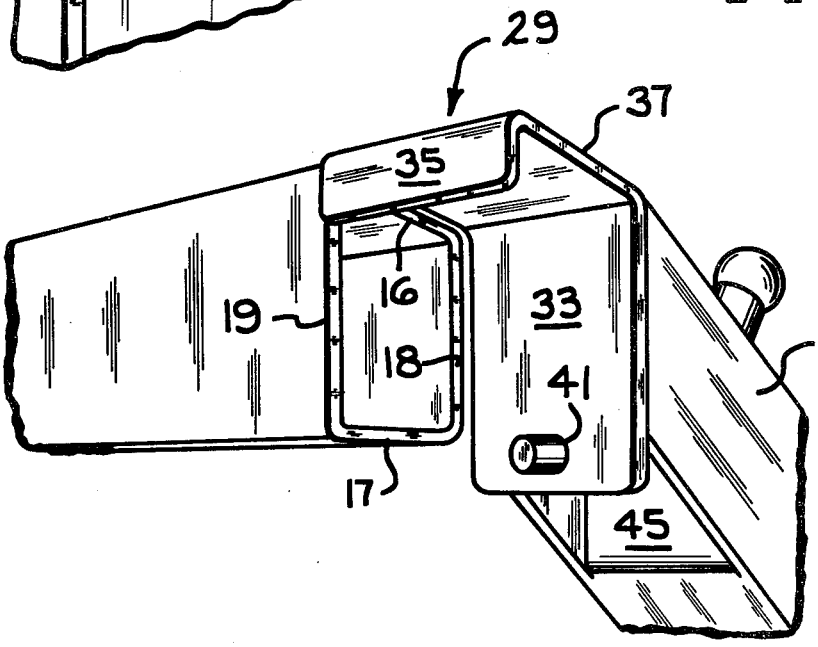
FIG. 2 is a partial perspective view of the mounting bracket of the present invention.

The invention of this patent application is directed to apparatus for mounting a hanger arm on a display fixture. More particularly, the hanger arm is slideably positioned on a hangrod in a manner that will prevent the hanger arm from being accidentally disengaged from the hangrod. The features of the invention will be more fully understood by referring to the attached drawings in connection with the following description of the invention.

The invention is used in connection with a display fixture 1 upon which garments and other items can be displayed in a store. The display fixture has a base 3, a surface 4 on the base and support arms 5 that extend from the surface of the base. The support arms 5 extend in a direction that is substantially perpendicular to the surface 4 of the base 3. The support arms have a first end 7 that is positioned in contact with the surface 4 of the base 3 and a second end 9 that is spaced apart from the base 3. At least two support arms 5 are positioned on the base 3 in opposed relationship.

A hangrod 15 is positioned between and connected to the opposed second ends 9 of the support arms 5. Accordingly, the hangrod is disposed in spaced apart parallel relationship with the surface 4 of the base 3 upon which the support arms 5 are mounted. The hangrod 15 has a top 16, a bottom 17, a first sidewall 18 and a second sidewall 19. The hangrod 15 is substantially rectilinear and is usually hollow. The support arms 5 and hangrod 15 are normally positioned so that the hangrod is disposed in a substantially horizontal plane.

A hanger arm 21 is removably positioned on the hangrod 15. The hanger arm 21 has a first end 23 that is positioned adjacent the hangrod 15 and a second end 25 that is spaced apart from the hangrod. The hanger arm 21 is usually substantially rectilinear in shape and has a hollow interior. A plurality of projections 27 can be positioned along the upper surface of the hanger arm for supporting the hooks of a garmet hanger.

A mounting bracket 29 is positioned on the first end 23 of the hanger arm 21. The mounting bracket 29 has a first member 33 positioned on the first end 23 of the hanger arm. The mounting bracket also includes a second member 35 that is in parallel spaced apart relationship to the first member 33. A spacer member 37 is positioned between and connects said first member 33 and said second member 35. The spacer member 37 is disposed to be substantially perpendicular to said first and second members. The spacer member 37 is constructed to have substantially the same width as the top 16 of the hangrod 15. The first member 33 is constructed to extend along the first sidewall 18 of the hangrod 15 and to extend below the bottom 17 of the hangrod. An aperture 41 is disposed in the portion of the first member 33 that extends below the bottom 17 of the hangrod 15. The aperture 41 is disposed to be in a plane immediately below and adjacent the bottom 17 of the hangrod 15. The second member 35 is disposed to extend at least along a portion of the sidewall 19 of the hangrod. Normally, the first member 33 is at least twice as long as the second member 35.

A portion of the bottom wall of the hanger arm 21 that is adjacent the first end 23 is bent to form a wall 45. The wall 45 is constructed to be substantially parallel and in opposed relationship with the first member 33 of the mounting bracket 29. The wall 45 contains an aperture 47 that is substantially in alignment with the aperture 41 in the first member 33 of the mounting bracket 29. Normally, the portion of the bottom wall is bent into the hollow interior of the hanger arm to form the wall 45. However, the wall can be formed in any appropriate manner or location that allows the aperture 47 to be in alignment with the aperture 41 in the first member 33.

A pin 51 having a first end 53 and a second end 55 is movably positioned in the aperture 41 in the first member 33 and in the aperture 47 in the wall 45. The first end 53 of the pin 51 extends through the aperture 41 in a direction towards the second member 35 of the mounting bracket 29. The second end 55 of the pin 51 extends through the aperture 47 in the wall 45 in a direction away from the first member 33. A flange 57 is positioned on the portion of the pin 51 that is located between the first member 33 and the wall 45. The flange 57 is securely positioned on the pin 51 and the flange has a diameter that is larger than the diameter of the aperture 41 in the first member 33 and the aperture 47 in the wall 45. A spring 61 is positioned around the portion of the pin 51 that is located between the first member 33 and the wall 45. One end of the spring engages the wall 45 and the other end of the spring engages the flange 57 on the pin 51. The spring 61 acts against the flange 57 to urge the flange 57 towards the first member 33 of the mounting bracket 29. Since the flange 57 is secured to the pin 51 the pin is also urged or biased in a direction towards the first member 33. The biasing of the pin 51 towards the hangrod 15 is limited by the flange 57. When the flange 57 comes into contact with the first member 33, the flange and pin are restricted from further movement towards the hangrod 15. It should be understood that the spring 61 only resiliently urges or biases the pin 51 towards the hangrod 15. If a force greater than the force of the spring 61 is applied to the first end 53 of the pin 51, the pin can be moved in a direction away from the hangrod 15 and the spring 61 will be compressed. In this manner, the pin 51 is movably positioned with respect to the first member 33 and the wall 45.

Figure 3:
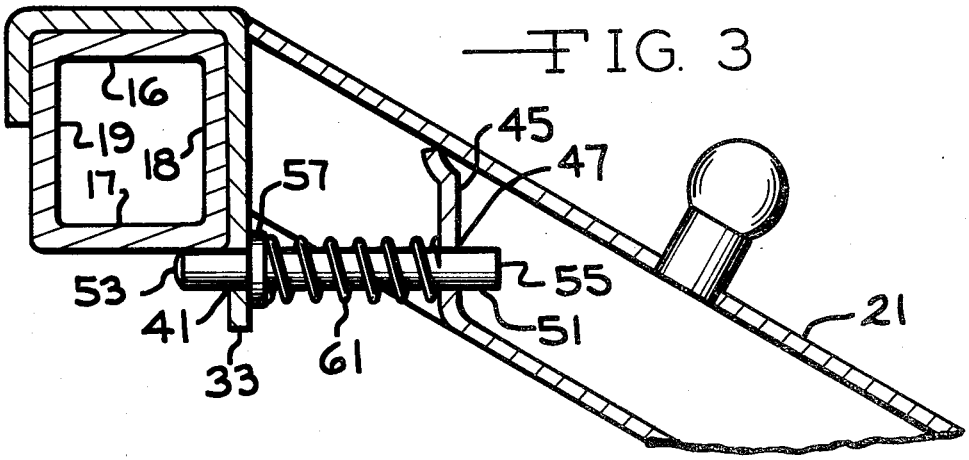
FIG. 3 is a partial cross-sectional view of the hanger arm mounting bracket of the present invention.

The aperture 41 in the first member 33 and the aperture 47 in the wall 45 are disposed so that the pin 51 is in a position to engage the bottom surface 17 of the hangrod 15 when the mounting bracket 29 is positioned on the hangrod as shown in FIG. 3. The pin 51 cooperates with the first member 33, second member 35, and spacer member 37 to secure the bracket 29 and the hanger arm 21 on the hangrod 15. The bracket 29 and hanger arm 15 is held in engagement on the hangrod until the pin 51 is moved and no longer is in engagement with the bottom 17 of the hangrod. In this manner, the hanger arm 21 is removably secured to the hangrod 15 and accidental disengagement of the hanger arm is prevented. However, it should be noted that the hanger arm 21 can be displaced in an axial direction along the hangrod 15 without removing the mounting bracket 29 or the hanger arm 21 from the hangrod 15.

To position the hanger arm 21 on the hangrod 15 the bottom of the first member 33 is positioned adjacent the first sidewall 18 of the hangrod 15 and the first member is advanced downwardly along the first sidewall. When the first end 53 of the pin 51 engages the hangrod 15, the pin 51 is displaced in a direction towards the wall 45 allowing the first member 33 to slide along the first sidewall 18 of the hangrod 15. The first member 33 advances along the first sidewall 18 of the hangrod 15 until the spacer member 37 comes into engagement with the top 16 of the hangrod 15. When the spacer member 37 is in engagement with the top wall the pin 51 is located beneath the bottom surface 17 of the hangrod 15 and the spring 61 acts against the flange 57 to bias the pin 51 in a direction towards the second member 35 of the mounting bracket 29. In this manner, the first end 53 of the pin 51 extends from the first member 33 and engages the bottom 17 of the hangrod 15. At the same time, the first member 33 and second member 35 are in engagement with the opposed sidewalls of the hangrod 15. In this manner the mounting bracket 29 and the pin 51 securely engage the hangrod 15 and prevent accidental disengagement of the hanger arm 21 from the hangrod 15.

To remove the hanger arm 21 from the hangrod 15 it is necessary to again displace the first end 53 of the pin 51 in a direction towards the wall 45 until the first end of the pin is no longer in engagement with the bottom 17 of the hangrod 15. When the pin 51 is in this position the first and second members of the mounting bracket 29 are advanced in an upwardly direction along the opposed sidewalls of the hangrod 15 until the second member 35 is positioned above the top 16 of the hangrod. When the second member 35 is positioned above the top 16 of the hangrod 15, the mounting bracket 29 and hanger arm 21 can be removed from the hangrod 15.

As shown in FIG. 1 the hanger arm 21 is positioned at an angle with respect to the first member 33 of the mounting bracket 29. However, it should be recognized that the hanger arm can be disposed in a different position with respect to the first member 33. In FIG. 1 there is shown hanger arm 21A that extends in a direction that is substantially perpendicular to the first member 33 of the mounting bracket 29.

Having described the invention in detail with reference to the drawings, it is understood that such specifications are given for the sake of explanation. Various modifications and substitutions, other than those cited, can be made without departing from the spirit and scope of the invention as defined in the following claims.

I claim:

1. A mounting bracket for a display fixture comprising:

a hangrod positioned on said display fixture;

a hanger arm for mounting on said display fixture;

a mounting bracket positioned on one end of said hanger arm, said bracket being disposed for engaging said hangrod to mount said hanger arm thereon;

a pin movably positioned in said mounting bracket, a first end of said pin extending from said bracket towards said hangrod, a second end of said pin extending from said bracket towards said hanger arm;

a flange disposed in said pin; and a spring disposed for engaging said flange on said pin, said spring biasing said movable pin towards said hangrod whereby said first end of said pin engages said hangrod to maintain said bracket and hanger arm in position on said hangrod.

2. The bracket of claim 1 wherein said bracket has a first member connected to the end of said hanger arm and a second member positioned in spaced apart opposed relationship to said first member.

3. The bracket of claim 2 wherein said bracket includes a spacer member that extends between said first and second members, said spacer member being substantially perpendicular to said first and second members.

4. The bracket of claim 3 wherein said first member is positioned adjacent one side of said hangrod and said second member is positioned adjacent an opposed side of said hangrod.

5. The bracket of claim 3 wherein said hangrod has an upper and a lower surface and said spacer member is positioned adjacent said upper surface of said hangrod.

6. The bracket of claim 3 wherein said first member, second member and spacer member form a substantially J-shaped bracket for engaging said hangrod.

7. The bracket of claim 2 wherein said first member contains an aperture and said pin is movably positioned in said aperture.

8. The bracket of claim 7 wherein said first end of said pin extends from said first member in a direction substantially perpendicular to said first member and towards said second member.

9. The bracket of claim 7 wherein said hanger arm contains an aperture and said second end of said pin is positioned in said aperture.

10. The bracket of claim 9 wherein a portion of said hanger arm is disposed substantially parallel to said first member of said bracket and said aperture is located in said portion of said hanger arm.

11. The bracket of claim 10 wherein said hanger arm is a hollow rectangular member having an upper and a lower surface, said lower surface of said hanger arm immediately adjacent said first member of said bracket being bent into said hollow interior of said hanger arm to form said portion that is parallel to said first member and where said aperture is located.

12. The bracket of claim 5 wherein said pin engages said surface of said hangrod that is opposite to said upper surface engaged by said spacer member.

13. The bracket of claim 10 wherein said flange is disposed for engaging said first member that is adjacent said hanger arm.

14. The bracket of claim 13 wherein said spring engages said portion of said hanger arm that is disposed parallel to said first member of said bracket and said flange on said pin.

15. The bracket of claim 13 wherein said flange is securely positioned on said pin and said flange is larger than said aperture in said first member whereby said flange acts as a stop to limit the travel of said pin in a direction towards said hangrod.

16. A mounting bracket for a display fixture comprising:

a hangrod disposed on said display fixture, said hangrod having a substantially rectilinear cross section, said hangrod having an upper and a lower surface;

a hanger arm having a first end and a second end, said hanger arm having a substantially rectilinear cross section;

a mounting bracket positioned on said first end of said hanger arm, said bracket having a first member positioned on said first end of said hanger arm and a second member spaced apart from and substantially parallel to said first member, said bracket further including a spacer member positioned between said connecting said first and second members, said first and second members being disposed for engaging opposed sides of said hangrod, said spacer member being disposed for engaging said upper surface of said hangrod, a portion of said first member extending below said lower surface of said hangrod;

an aperture positioned on said portion of said first member that extends below said lower surface of said hangrod;

a portion of said hanger arm adjacent said bracket being disposed to form a wall that is substantially parallel to said first member of said mounting bracket;

an aperture positioned in said wall formed by said portion of said hanger arm, said aperture being in substantial alignment with said aperture in said first member;

a pin movably positioned in and extending between said aperture in said first member and said aperture in said wall of said hanger arm, one end of said pin extending from said aperture in said first member towards said hangrod; and means for biasing said pin towards said hangrod whereby said pin releasably engages said lower surface of said hangrod to secure said mounting bracket and hanger arm to said hangrod.

17. The bracket of claim 16 wherein said display fixture includes support arms that extend from said display fixture, said hangrod being suspended from said support arms.

18. A mounting bracket for a display fixture comprising:

a pair of support arms that extend from said display fixture;

a hangrod suspended on said support arms and positioned in a horizontal plane, said hangrod having a substantially rectilinear cross section, said hangrod having an upper and lower surface;

a hanger arm having a first and second ends upon which items to be displayed can be positioned, said hanger arm being hollow and having a substantially rectilinear cross section, a portion of one side of said hanger arm adjacent said first end of said hanger arm being bent into said hollow interior;

an aperture positioned in said bent portion of said hanger arm;

a mounting bracket positioned on said first end of said hanger arm, said bracket having a first member positioned adjacent said first end of said hanger arm and a second member spaced apart from and substantially parallel to said first member, said bracket further including a spacer member positioned between and connecting said first and second members, said spacer member being substantially perpendicular to said first and second members, said first and second members being disposed for engaging opposed sides of said hangrod, said spacer member being disposed for engaging said upper surface of said hangrod, a portion of said first member extending below said lower surface of said hangrod;

an aperture positioned on said portion of said first member that extends below said bottom of said hangrod, said aperture being in substantial alignment with said aperture in said bent portion of said hanger arm;

a pin movably positioned in said aperture in said first member and said aperture in said bent portion of said hanger arm, a first end of said pin extending from said aperture in said first member towards said hangrod;

a flange positioned on said portion of said pin that extends between said first member and said bent portion; and a spring positioned on said portion of said pin, said spring having one end in contact with said bent portion and the other end in contact with said flange whereby said spring acts against said flange to urge said pin towards said hangrod whereby said first end of said pin engages said lower surface of said hangrod to secure said bracket and hanger arm to said hangrod.

19. The bracket of claim 18 wherein said mounting bracket and pin slideably engage said hangrod whereby said bracket and hanger arm can be slideably positioned along said hangrod without removing said bracket from engagement with said hangrod.

* * * * *